US011884308B2

(12) United States Patent
Marcantonini

(10) Patent No.: US 11,884,308 B2
(45) Date of Patent: Jan. 30, 2024

(54) TRANSPORT DEVICE FOR TRANSPORT OF LOADS SUSPENDED ON TRACKS RAISED WITH RESPECT TO THE GROUND

(71) Applicant: MCT ITALY S.r.l., Bettona (IT)

(72) Inventor: Lamberto Marcantonini, Bettona (IT)

(73) Assignee: MCT ITALY S.R.L., Bettona (IT)

( * ) Notice: Subject to any disclaimer, the term of this patent is extended or adjusted under 35 U.S.C. 154(b) by 694 days.

(21) Appl. No.: 17/059,851

(22) PCT Filed: Jun. 3, 2019

(86) PCT No.: PCT/IB2019/054570
§ 371 (c)(1),
(2) Date: Nov. 30, 2020

(87) PCT Pub. No.: WO2019/234579
PCT Pub. Date: Dec. 12, 2019

(65) Prior Publication Data

US 2021/0323582 A1 Oct. 21, 2021

(30) Foreign Application Priority Data

Jun. 4, 2018 (IT) ..... 102018000005990

(51) Int. Cl.
*B61B 5/02* (2006.01)
*B61C 13/04* (2006.01)

(52) U.S. Cl.
CPC ..... *B61B 5/02* (2013.01); *B61C 13/04* (2013.01)

(58) Field of Classification Search
CPC .... B61B 3/00; B61B 3/02; B61B 5/00; B61B 5/02; B61B 10/00; B61B 10/001; B61B 10/02; B61B 10/022; B61C 13/04
See application file for complete search history.

(56) References Cited

U.S. PATENT DOCUMENTS

| | | | | |
|---|---|---|---|---|
| 4,841,871 A * | 6/1989 | Leibowitz | B61C 13/04 104/23.1 |
| 2017/0299112 A1* | 10/2017 | Sauret | B61B 5/02 |
| 2018/0099680 A1* | 4/2018 | Murakami | B60L 5/00 |
| 2018/0100274 A1* | 4/2018 | Horii | B61K 9/08 |

FOREIGN PATENT DOCUMENTS

| | | | |
|---|---|---|---|
| CH | 689420 A5 * | 4/1999 | B61B 3/02 |
| CN | 101495357 A | 7/2009 | |
| EP | 1690769 A2 | 8/2006 | |
| WO | WO 2017075115 A1 | 5/2017 | |

* cited by examiner

*Primary Examiner* — Robert J McCarry, Jr.

(74) *Attorney, Agent, or Firm* — R. Neil Sudol; Henry D. Coleman

(57) ABSTRACT

A device for transporting loads suspended on raised tracks over a ground surface includes a container of materials to be transported, a structure supporting the container, and a movement mechanism for moving along the tracks, having a first motorised wheel and a second motorised wheel, independent of one another and activatable about axes of rotation coaxial with and perpendicular to the two longitudinal sides of the supporting structure. The transport device has a stabilizer with at least a first idle rolling element and at least a second idle rolling element coupled to the supporting structure so as to be arranged on opposite sides with respect to the coaxial axes of rotation of the first motorised wheel and the second motorised wheel, so as to be pivoting about axes parallel to the two longitudinal sides of the supporting structure and the tracks.

6 Claims, 4 Drawing Sheets

TRANSPORT DEVICE FOR TRANSPORT OF LOADS SUSPENDED ON TRACKS RAISED WITH RESPECT TO THE GROUND

FIELD OF THE INVENTION

The present invention relates to the technical sector concerning systems and devices for transport of suspended loads which move support by raised tracks with respect to the ground surface and which define the path along which the suspended loads are to be transferred and transported.

DESCRIPTION OF THE PRIOR ART

The suspended loads are constituted by containers in which materials are stored which can be transported from one point to another internally of factories or work structures.

For example, the materials which are stored internally of the containers can consist of concrete or another type of construction material, such as for example sand, gravel, mortar, bricks and so on.

Usually, for transport of this type of suspended loads, transport devices are used that, in the sector, are called wagons, and which are destined to travel, i.e. to be moved, along raised tracks with respect to the ground.

The loads are called suspended as the tracks, as specified, are predisposed and installed at a certain height with respect to the ground and are arranged parallel to one another, at a same height from the ground, and extend along a given path.

A known transport device of suspended loads comprises a support structure, a container, in which the materials to be transported can be stored, which is borne by the support structure in such a way that the container is arranged inferiorly of the support structure, and movement means which are associated to the support structure, for the movement of the support structure, and therefore of the container, along the tracks.

In particular, the support structure is realised in such a way as to have a conformation that is such as to have a central opening and the container is coupled and fixed to the support structure so as to be positioned below the opening.

For example, the support structure can have a quadrangular conformation, for example rectangular or square, thus with two longitudinal lateral walls, parallel to the direction of movement along the tracks, and two transversal lateral walls. In this way the container can be loaded from above with the material to be transported.

The movement means consist of a first motorised wheel and a second motorised wheel.

The first motorised wheel is mounted on a first side of the support structure, for example on a first longitudinal lateral wall of the support structure, so as to be in contact with a first track, while in turn the second motorised wheel is mounted on a second side, opposite the first, of the support structure, for example on the second longitudinal lateral wall so as to be in contact with a second track.

The first motorised wheel is rotatably mounted about an axis of rotation perpendicular to the first side of the support structure and the second motorised wheel is rotatably mounted about an axis of rotation perpendicular to the second side of the support structure.

The first motorised wheel and the second motorised wheel are activated in rotation independently of one another and are predisposed on the support structure so that the relative axes of rotation are coaxial to one another.

With this configuration, the container is arranged at a lower level than the two wheels and therefore also lower than the tracks.

For the purposes of the transport device, the container is coupled and predisposed on the support structure in such a way that the relative centre of gravity is located at a plane that is transversal and median to the support structure, and the two motorised wheels are in turn coupled and predisposed on the support structure in such a way that the relative axes of rotation, coaxial to one another, are on the transversal median plane of the support structure.

The transport devices of suspended loads realised and structured in such a way as to have the above-described configuration have, however, a drawback.

The materials to be transported (concrete, other construction material, such as for example sand, gravel, bricks etc.), which are predisposed in the container, have a considerable weight and therefore the inertia forces at play are quite significant.

This can lead, during the acceleration or deceleration step, for example during the starting or stopping of the transport device, the material inside the container changes the original position thereof, thus leading to an unbalancing of the load with respect to the points of contact of the two motorised wheels with the tracks.

Therefore there can be a consequent onset of oscillations and problems of stability.

SUMMARY OF THE INVENTION

The aim of the present invention is thus to provide a new transport device for transport of loads suspended on tracks raised with respect to the ground, able to obviate the mentioned drawback.

In particular, an aim of the invention is to provide a transport device that is able to guarantee excellent stability of the suspended load during the movement along the tracks, in both the acceleration and deceleration steps.

The above aims are attained by a transport device for transport of loads suspended on tracks raised with respect to the ground, according to claim 1. Other advantageous characteristics of the transport device according to the invention are set down in the various claims dependent on claim 1.

BREVE DESCRIPTION OF THE DRAWINGS

A preferred embodiment of the transport device for transport of loads suspended on tracks raised with respect to the ground of the present invention will be described in the following with reference to the appended tables of drawings, in which:

FIG. 1, in a schematic lateral view, illustrates the transport device of the invention alone, i.e. without any illustration of the tracks on which it moves;

DESCRIPTION OF PREFERRED EMBODIMENTS

With reference to the accompanying tables of drawings, reference (D) denotes in its entirety the transport device for transport of loads suspended on raised tracks with respect to the ground surface.

The tracks (R) along which the transport device (D) is to be moved comprise, in a known way, a first track (R1) and a second track (R2) arranged parallel to one another and defining the transport and transfer path of the suspended loads.

For example, both the first track (R1) and the second track (R2) are conformed in such a way as to have a T shape, or a double-T shape, one overturned with respect to the other, so as to have an upper surface or plane that identify the movement path of the transport device.

Figure 2:
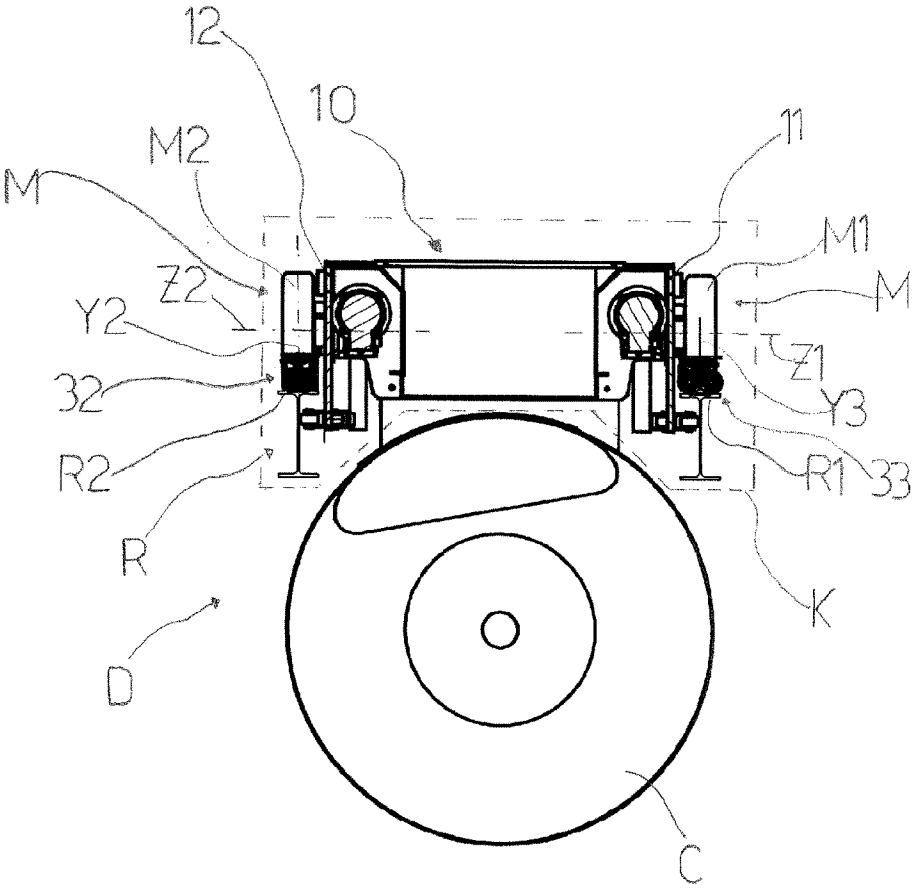
FIG. 2 is a view along section line A-A of FIG. 1, with the addition of the tracks.
Figure 1:
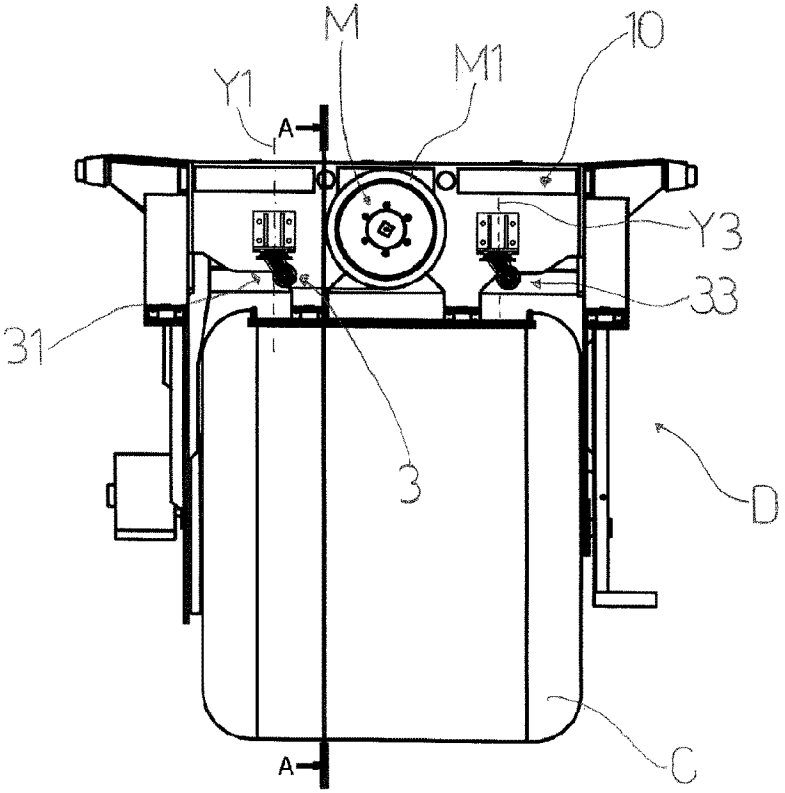
Figure 3:
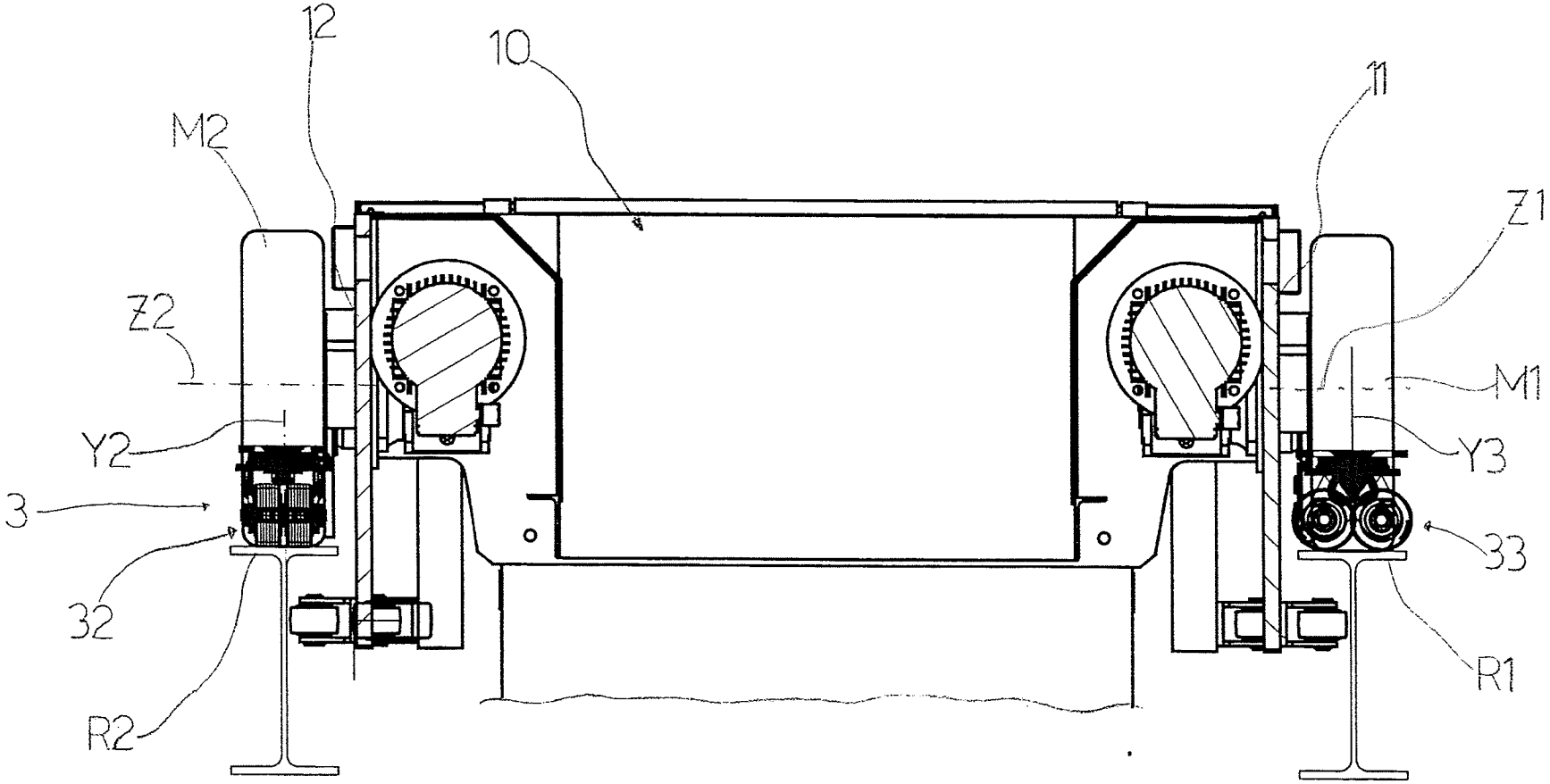
FIG. 3 is a larger-scale view of the detail denoted by K in FIG. 2.
Figure 4:
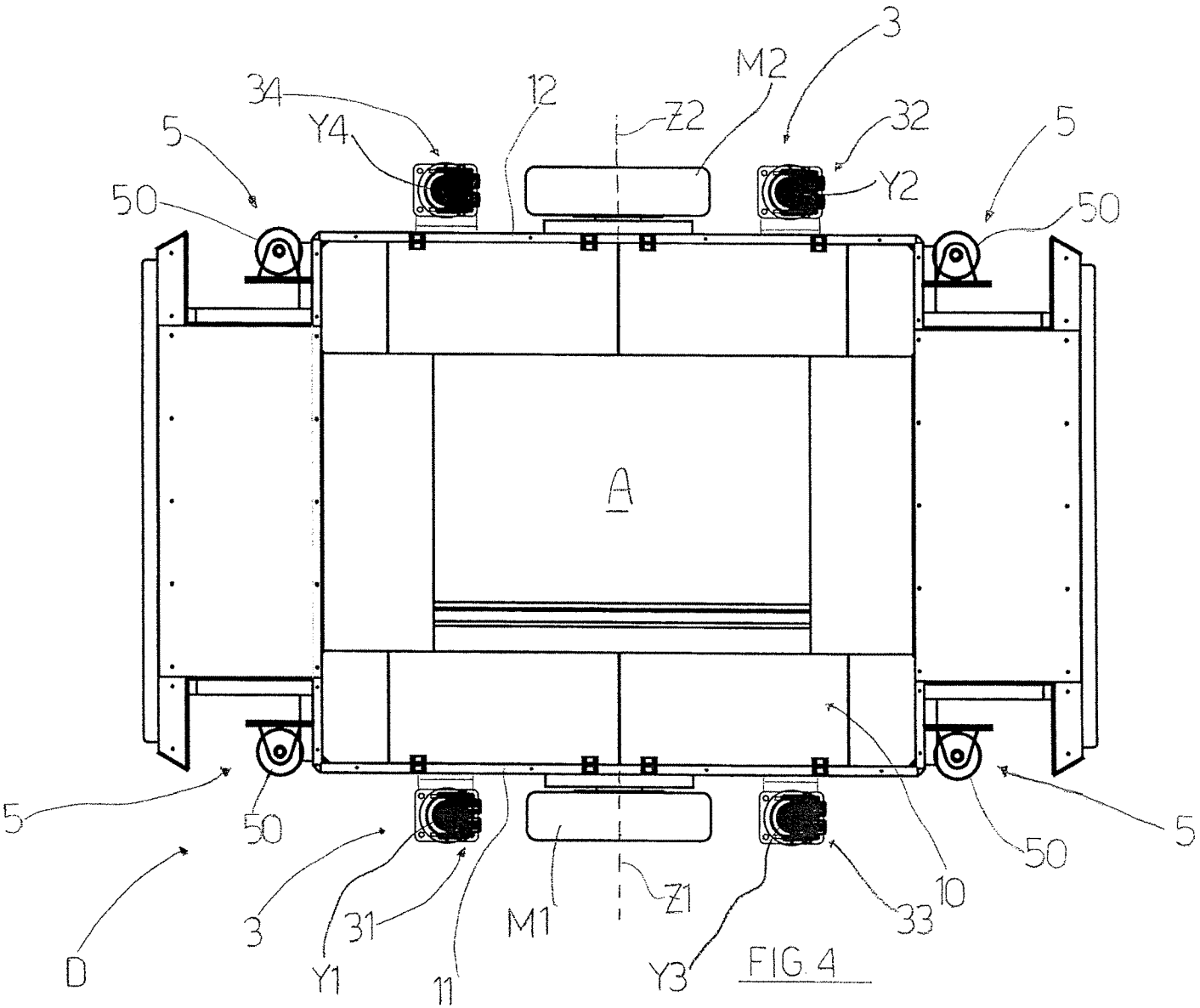
FIG. 4 is a schematic view from above of the transport device of the invention alone, i.e. without any illustration of the tracks on which it travels.

For example, FIGS. 2 and 3 illustrate tracks (R) comprising a first track (R1) and a second track (R2) having a double-T shape, one overturned with respect to the other.

The transport device (D) comprises a container (C) for containing internally thereof materials to be transported, superiorly open, for the loading/unloading of the materials, or provided with an opening in the lower part that is openable by means of a movable hatch door for unloading the materials, and a support structure (10) for support of the container (C), which support structure (10) is realised in such a way as to have a first longitudinal side (11) and a second longitudinal side (12) that are parallel to one another.

For example, the support structure (10) can have a quadrangular frame, for example rectangular or square, with a first longitudinal side (11) and a second longitudinal side (12) that are parallel to one another, and two sides that are transversal to the two longitudinal sides.

The container (C) is coupled to the support structure (10) in such a way as to be arranged below the support structure (10) at a central opening (A) present in the support structure (10), to enable loading and inserting of materials internally of the container (C).

The transport device (D) further comprises movement means (M), for movement of the support structure (10), and therefore of the container (C), along the tracks (R).

The movement means (M) consist of a first motorised wheel (M1) and a second motorised wheel (M2) which are predisposed and coupled to the support structure (10) in the following configuration:

the first motorised wheel (M1) is mounted at the first longitudinal side (11) of the support structure (10) so as to be in contact with a first track (R1) and the second motorised wheel (M2) is mounted at the second longitudinal side (12) of the support structure (10) so as to be in contact with a second track (R2), when the transport device (D) is positioned on the tracks (R);

the first motorised wheel (M1) is rotatably mounted about an axis of rotation (Z1) perpendicular to the first longitudinal side (11) of the support structure (10) and the second motorised wheel (M2) is rotatably mounted about an axis of rotation (Z2) perpendicular to the second longitudinal side (12) of the support structure (10);

the first motorised wheel (M1) and the second motorised wheel (M2) are predisposed on the support structure (10) so that the relative axes of rotation (Z1, Z2) are coaxial to one another and are activatable in rotation independently of one another.

With this configuration, the container (C) is arranged at a lower level than the tracks (R).

The peculiarities of the transport device (D) of the present invention consist in the fact that it comprises stabilising means (3) for stabilising the transport device (D) when materials are present in the container (C) and when the transport device (D) is travelling along the tracks (R), in particular during acceleration steps, for example when starting, or deceleration steps, for example when it has to stop at a given position for the unloading of the material.

The stabilising means (3) further comprise at least a first idle rolling element (31) and at least a second idle rolling element (32), which are predisposed in the following special way.

The first idle rolling element (31) is coupled to the support structure (10) so as to be arranged in such a way as to be in contact with the first track (R1) when the transport device (D) is positioned on the tracks (R) and to be able to roll on the first track (R1) when the transport device (D) is moved along the tracks (R), while the second idle rolling element (32) is coupled to the support structure (10) so as to be arranged in such a way as to be in contact with the second track (R2) when the transport device (D) is positioned on the tracks (R) and to be able to roll on the second track (R2) when the transport device (D) is moved along the tracks (R).

In greater detail, the first idle rolling element (31) and the second idle rolling element (32) are coupled to the support structure (10) in such a way as to be arranged on opposite sides with respect to the coaxial axes of rotation of the first motorised wheel (M1) and the second motorised wheel (M2).

For example, considering a given direction of movement of the transport device (D) along the tracks, the first idle rolling element (31) can be arranged upstream (or downstream) of the axis of rotation (Z1) of the first motorised wheel (M1), while the second idle rolling element (32) can be arranged downstream (or upstream) of the axis of rotation (Z2) of the second motorised wheel (M2).

Further, another peculiarity of the transport device (D) of the invention consists in the fact that the first idle rolling element (31) is coupled to the support structure (10) so as to be pivoting about an axis (Y1) parallel to the first longitudinal side (11) of the support structure (10) and perpendicular to the first track (R1) and that the second idle rolling element (32) is coupled to the support structure (10) so as to be pivoting about an axis (Y2) parallel to the second longitudinal side (12) of the support structure (10) and perpendicular to the second track (R2).

In this way, thanks to the presence of the first idle rolling element (31) and the second idle rolling element (32), on opposite sides with respect to the axes of rotation of the two motorised wheels (M1, M2), the transport device (D) has two further points of contact (as well as the two constituted by the two motorised wheels) with the first and second track which are arranged on opposite sides of the axes of rotation of the two motorised wheels.

This special arrangement of the first and second idle rolling element (31, 32) enables providing a more balanced configuration to the transport device, especially during an acceleration or deceleration stage, during which the material inside the container tends to move with respect to the load configuration due to inertia forces.

In this way the transport device (D) prevents the onset of any oscillation of the container, which is instead kept stable.

Further, the fact that the first idle rolling element (31) and the second idle rolling element (32) are both pivoting about axes of rotation (Y1, Y2) which are parallel to the two longitudinal sides (11, 12) of the support structure (10) and perpendicular to the two tracks (R1, R2) enables them to adapt their position with respect to the support structure (10) at curved portions of the tracks.

This prevents the onset of undesired dragging since as the position thereof can be adapted with respect to the support structure when the transport device is moved along curved portions of the tracks, the idle rolling elements can continue to roll on the two tracks substantially without any particular problems.

Further advantageous characteristics of the transport device (D) of the invention are described in the following.

To increase the stability, the transport device (D) can be predisposed in such a way that the stabilising means (3) can further comprise at least a third idle rolling element (33) and at least a fourth idle rolling element (34), arranged in the special following way.

The third idle rolling element (33) is coupled to the support structure (10) in such a way as to be positioned on the opposite side of the first rolling element (31) with respect to the axis of rotation (Z1) of the first motorised wheel (M1), and so as to be in contact with the first track (R1) when the transport device (D) is positioned on the tracks (R) and to be able to roll on the first track (R1) when the transport device (D) is moved along the tracks (R).

In turn, the fourth idle rolling element (34) is coupled to the support structure (10) in such a way as to be positioned on the opposite side of the second rolling element (32) with respect to the axis of rotation (Z2) of the second motorised wheel (M2), and in such a way as to be in contact with the second track (R2) when the transport device (D) is positioned on the tracks (R) and to be able to roll on the second track (R2) when the transport device (D) is moved along the tracks (R).

In this way the transport device (D) will be even more balanced and stable as it will have a further four points of contact with the tracks, as well as the two constituted by the two motorised wheels (M1, M2).

As for the first and second idle rolling elements, the third idle rolling element (33) is coupled to the support structure (10) so as to be pivoting about an axis parallel to the first longitudinal side (11) of the support structure (10) and perpendicular to the first track (R1) and the fourth idle rolling element (34) is coupled to the support structure (10) in such a way as to be pivoting about an axis that is parallel to the second longitudinal side (12) of the support structure (10) and perpendicular to the second track (R2).

The idle rolling elements (first, second, third, fourth) are preferably constituted by single rollers, or pairs of rollers that are parallel to one another, which are borne idle by a first plate which is rotatably mounted on a second plate which is coupled to the support structure so as to be parallel to the tracks and perpendicular to the longitudinal sides of the support structure.

The first plate is rotatably mounted on the second plate according to an axis perpendicular to the second plate.

The first idle rolling element (31) and the second idle rolling element (32) are preferably arranged at a same distance with respect to the axes of rotation (Z1, Z2) of the first (M1) and second (M2) motorised wheel.

Correspondingly, in the case of use of the third and fourth idle rolling element, the third idle rolling element (33) and the fourth idle rolling element (34) are also arranged at a same distance with respect to the axes of rotation of the first (M1) and second (M2) motorised wheels, preferably corresponding to the distance of the first and second idle rolling element from the axes of rotation (Z1, Z2) of the two motorised wheels.

In a further advantageous aspect, the transport device (D) can preferably comprise guide means (5) for guiding the support structure (10) at the curved portions (RC) of the transport path of the tracks (R).

Figure 5:
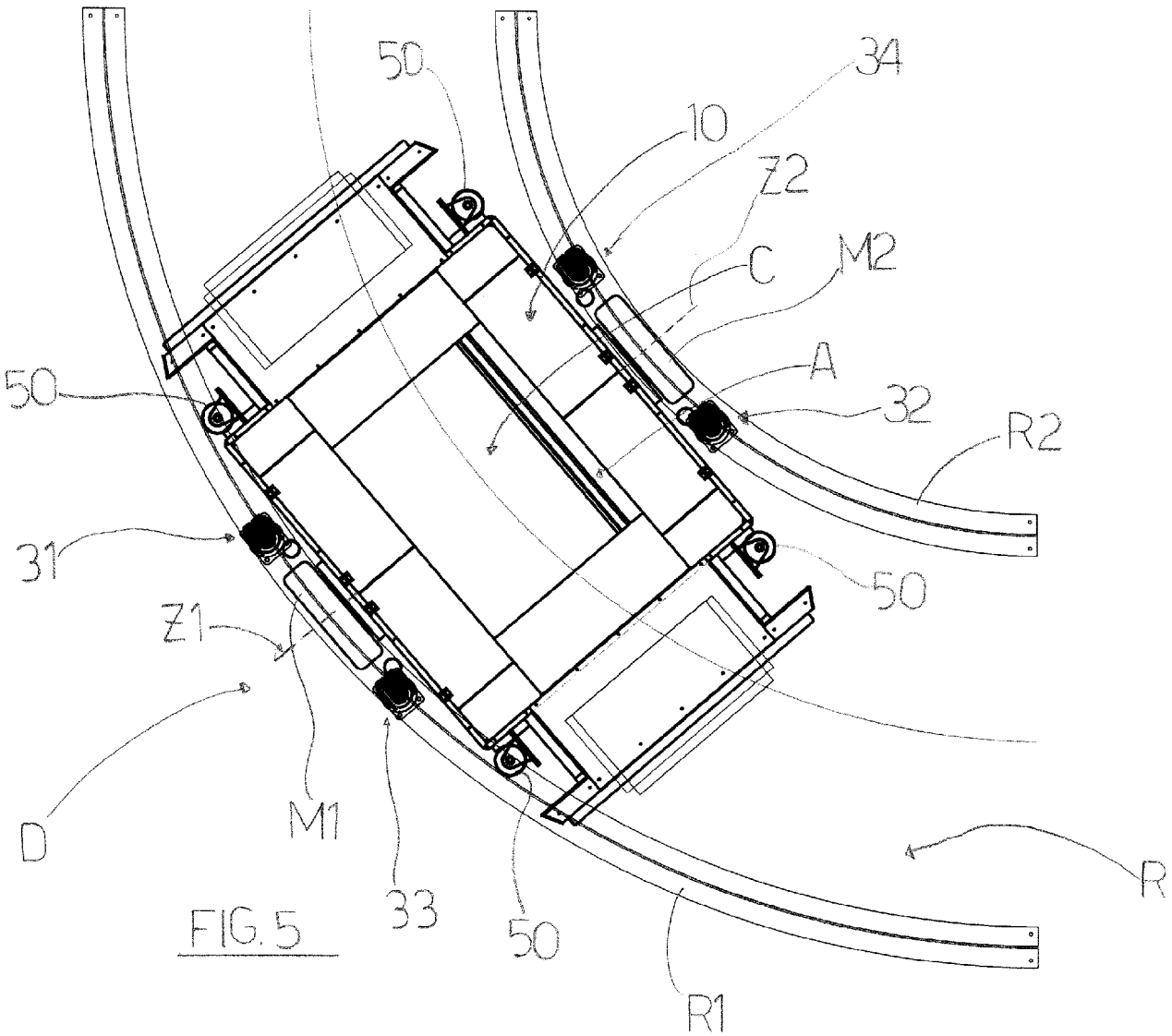
FIG. 5 is a schematic view from above of the transport device of the invention illustrated while it is travelling along a curved portion of the tracks on which it is moving for the transport of suspended loads.

The guide means (5) comprise rollers (50) that are idle about vertical axes of rotation which are mounted on the support structure (10) in such a way as to be able to contact the tracks (R) when the transport device (D) is moved along curved portions and to maintain the first motorised wheel (M1) and the second motorised wheel (M2) respectively in contact with the first track (R1) and the second track (R2) (see for example FIG. 5).

The invention claimed is:

1. A transport device for transport of loads suspended on raised tracks with respect to the ground surface, the tracks comprising a first track and a second track arranged parallel to one another and defining the transport and transfer path of the suspended loads, the transport device comprising:

a container for containing internally thereof materials to be transported, a support structure of the container, having a shape such as to have a first longitudinal side and a second longitudinal side that are parallel to one another, the container being coupled to the support structure in such a way as to be arranged below the support structure at a central opening present in the support structure, movement means, for movement of the support structure, and therefore of the container, along the tracks, the movement means consisting of a first motorised wheel and a second motorised wheel wherein:

the first motorised wheel is mounted at the first longitudinal side of the support structure so as to be in contact with a first track and the second motorised wheel is mounted at the second longitudinal side the support structure so as to be in contact with a second track, when the transport device is positioned on the tracks;

the first motorised wheel is rotatably mounted about an axis of rotation perpendicular to the first longitudinal side of the support structure and the second motorised wheel is rotatably mounted about an axis of rotation perpendicular to the second longitudinal side of the support structure, the first motorised wheel and the second motorised wheel are predisposed on the support structure so that the relative axes of rotation are coaxial to one another and are activatable in rotation independently of one another, stabilising means comprising at least a first idle rolling element and at least a second idle rolling element, wherein:

the first idle rolling element is coupled to the support structure so as to be arranged in such a way as to be in contact with the first track when the transport device is positioned on the tracks and to be able to roll on the first track when the transport device is moved along the tracks, the second idle rolling element is coupled to the support structure so as to be arranged in such a way as to be in contact with the second track when the transport device is positioned on the tracks and to be able to roll on the second track when the transport device is moved along the tracks, the first idle rolling element and the second idle rolling element are coupled to the support structure in such a way as to be arranged on opposite sides with respect to the coaxial axes of rotation of the first motorised wheel and the second motorised wheel, and in that the first idle rolling element is coupled to the support structure so as to be pivoting about an axis parallel to the first longitudinal side of the support structure and perpendicular to the first track and that the second idle rolling element is coupled to the support structure so as to be pivoting about an axis parallel to the second longitudinal side of the support structure and perpendicular to the second track.

2. The transport device claim 1, wherein the stabilising means further comprise at least a third idle rolling element and at least a fourth idle rolling element, wherein:

the third idle rolling element is coupled to the support structure in such a way as to be positioned on the opposite side of the first rolling element with respect to the axis of rotation of the first motorised wheel, and so as to be in contact with the first track when the transport device is positioned on the tracks and to be able to roll on the first track when the transport device is moved along the tracks, the fourth idle rolling element is coupled to the support structure in such away as to be positioned on the opposite side of the second rolling element with respect to the axis of rotation of the second motorised wheel, and in such a way as to be in contact with the second track when the transport device is positioned on the tracks and to be able to roll on the second track when the transport device is moved along the tracks, the third idle rolling element being coupled to the support structure so as to be pivoting about an axis parallel to the first longitudinal side of the support structure and perpendicular to the first track, the fourth idle rolling element being coupled to the support structure so as to be pivoting about an axis parallel to the second longitudinal side of the support structure and perpendicular to the second track.

3. The transport device of claim 1, wherein the first idle rolling element and the second idle rolling element are arranged at a same distance with respect to the axes of rotation of the first and second motorised wheels.

4. The transport device of claim 2, wherein the third idle rolling element and the fourth idle rolling element are arranged at a same distance with respect to the axes of rotation of the first and second motorised wheels.

5. The transport device of claim 1, further comprising guide means for guiding the support structure at curved portions of the transport path of the tracks, the guide means comprising rollers that are idle about vertical axes of rotation which are mounted on the support structure in such a way as to contact the tracks when the transport device is moved along curved portions and to maintain the first motorised wheel and the second motorised wheel respectively in contact with the first track and the second track.

6. The transport device of claim 3, wherein the third idle rolling element and the fourth idle rolling element are arranged at a same distance with respect to the axes of rotation of the first and second motorised wheels.

* * * * *